United States Patent [19]

Roeder et al.

[11] 4,247,043

[45] Jan. 27, 1981

[54] DEVICE FOR MARKING WORKPIECES BY MEANS OF POWDER

[75] Inventors: Georg Roeder; Helmut Sachs, both of Frankfurt am Main; Dieter Hajok, Hattersheim, all of Fed. Rep. of Germany

[73] Assignee: Messer Griesheim GmbH, Frankfurt am Main, Fed. Rep. of Germany

[21] Appl. No.: 31,023

[22] Filed: Apr. 18, 1979

[30] Foreign Application Priority Data

Apr. 29, 1978 [DE] Fed. Rep. of Germany ..... 2819146

[51] Int. Cl.[3] ..... B05B 7/16

[52] U.S. Cl. ..... 239/85; 239/143; 239/419.3

[58] Field of Search ..... 239/79, 81, 85, 143, 239/419.3

[56] References Cited

U.S. PATENT DOCUMENTS

| | | | |
|---|---|---|---|
| 2,389,702 | 11/1945 | Ullmer | 239/85 X |
| 3,722,818 | 3/1973 | Hayasaki et al. | 239/85 |

*Primary Examiner*—Andres Kashnikow

*Attorney, Agent, or Firm*—Connolly and Hutz

[57] ABSTRACT

A device for marking workpieces by means of powder includes a nozzle from which emanates a powder spray circumscribed by a heating flame with a burner being at one end of the nozzle attached for powder marking and whose other end is attached to a powder container connected to the nozzle via a tube.

12 Claims, 5 Drawing Figures

DEVICE FOR MARKING WORKPIECES BY MEANS OF POWDER

BACKGROUND OF INVENTION

The invention herein described deals with a device for marking workpieces by means of powder, using a nozzle from which emanates concentrically, a powder spray circumscribed by a heating flame.

This popular marker serves to construct lines or points on metallic surfaces and is mostly applied in industry using iron, as for example in the ship-container or steel construction industry.

Apart from the device for marking and the machine upon which the device is mounted, for example a flame cutting machines, it is necessary to have supplies of powder, gas (preferably oxygen) for propelling the powder from a powder reservoir to the marking nozzle and a fuel gas mixture.

The heating flame formed by the fuel gas mixture causes a transformation of the powder from its solid state into the liquid state, whereby the heat of combustion of the mixture also aids in bonding the transformed powder to the workpiece. After leaving the marking nozzle in the appropriate powder canal as a spray of powder-oxygen mixture, the powder reaches an enlosed heating flame-structured ring slot in which the physical transformation of the powder occurs, thus changing in the liquid phase into the form of a line or of points which become imprinted on the surface of the workpiece. From the synthetic powders made of epoxy resin, which have hitherto been used, there has now been a switch over to the use of pure metallic powders whose melting point is essentially higher than that of the synthetic powder.

As far as the state of the technology is concerned, reference is made to German patent DE-PS No. 2 112 083 in which a flame cutting and marking device for marking workpieces is described. This popular device consists of the usual cutting torch which can be connected to a powder container by way of a switch valve. Depending upon the position of the valve, the cutting torch is either connected to the powder container or directly to a cutting oxygen conductor, whereby, in this case, the cutting torch serves the purpose of completely cutting through the material.

SUMMARY OF INVENTION

The object of the present invention is to provide a compact device, whose sole application is to mark workpieces by means of powder.

To meet these requirements, the invention is specially equipped with a burner at one end of which a nozzle for powder marking is attached and to whose other end a powder container is attached; the powder container is connected to the nozzle by way of a tube. By means of this compact construction, a device is obtained, which has the advantage that it can be attached to any point of the flame cutting machine without problems: it is only necessary then to connect the device to the gas supply and plug in the ignition current cable.

It is envisaged in this invention that the nozzle is supplied with a mixer for producing the fule-gas-oxygen mixture for the heating flame and that the gasses can be fed into the mixture by way of separate pipes from the burner. According to the invention, the construction plan allows for secondary pipes, in which controlling valves are located, to branch off from the oxygen pipe.

And as set forth in the preferred embodiment of the invention, it is further envisaged that the first secondary pipe is connected to an intermediary mixture and a projection of the powder container is in the area formed by the burner. In this connection, the invention is deemed to have particular advantages if the wall of the tube is equipped with a bore through which the space can be connected to both the interior of the powder container and the central canal of the nozzle. It is further envisaged, according to the invention, that the second pipe is connected to an annulus at the base of the powder container.

Through the two branch-off secondary pipes, which derive from the main oxygen pipe (for the heating oxygen) in which the controlling valves are located, it is possible to adjust the width of the marking line by means of one controlling valve; and then by changing the distance between the nozzle and the surface of the workpiece by means of appropriate adjustment of the other valve, it is possible to collate the corresponding length of the oxygen-powder spray as a function of the altered distance.

In order to guarantee steady supply of powder to the tube, it is further envisaged that the invention be equipped with a powder container, at the base of which swirl-type nozzles are located; these nozzles have a middle bore, which opens into the annulus. According to a further suggestion of the invention, these swirl-type nozzles have a main body upon which a locking cap is screwed, thereby forming an annular clearance or recess between the cap and the main body which is connected to the interior of the powder container and middle bore through an opening in the cap.

By placing the swirl-type nozzles in the interior of the powder container, the steady flow of oxygen and powder is guaranteed and this uniformly reaches the tube. To prevent an over-spilling of powder over the swirl-type nozzles in the oxygen filled chamber when the device is shut off, the invention is further equipped with a sealing bearing at the upper end of the middle bore of the main body of each swirl-type nozzle. This bearing, which is normally in the closed position, prevents the powder from reaching the interior of the middle bore and consequently from getting into the oxygenfilled chamber.

Since the secondary pipes branch off from the main oxygen conduit (for heating oxygen), the invention ensures that the powder can only flow out of the nozzle when, simultaneously, a fuel-gas mixture flows from it. This is only the case, however, if the fuel gas pulls the oxygen along according to the principle of injection, whereby, in this case, part of the heating oxygen sidetracks into the secondary pipes and thus serves to propel the powder.

THE DRAWINGS

DETAILED DESCRIPTION

Figure 1:
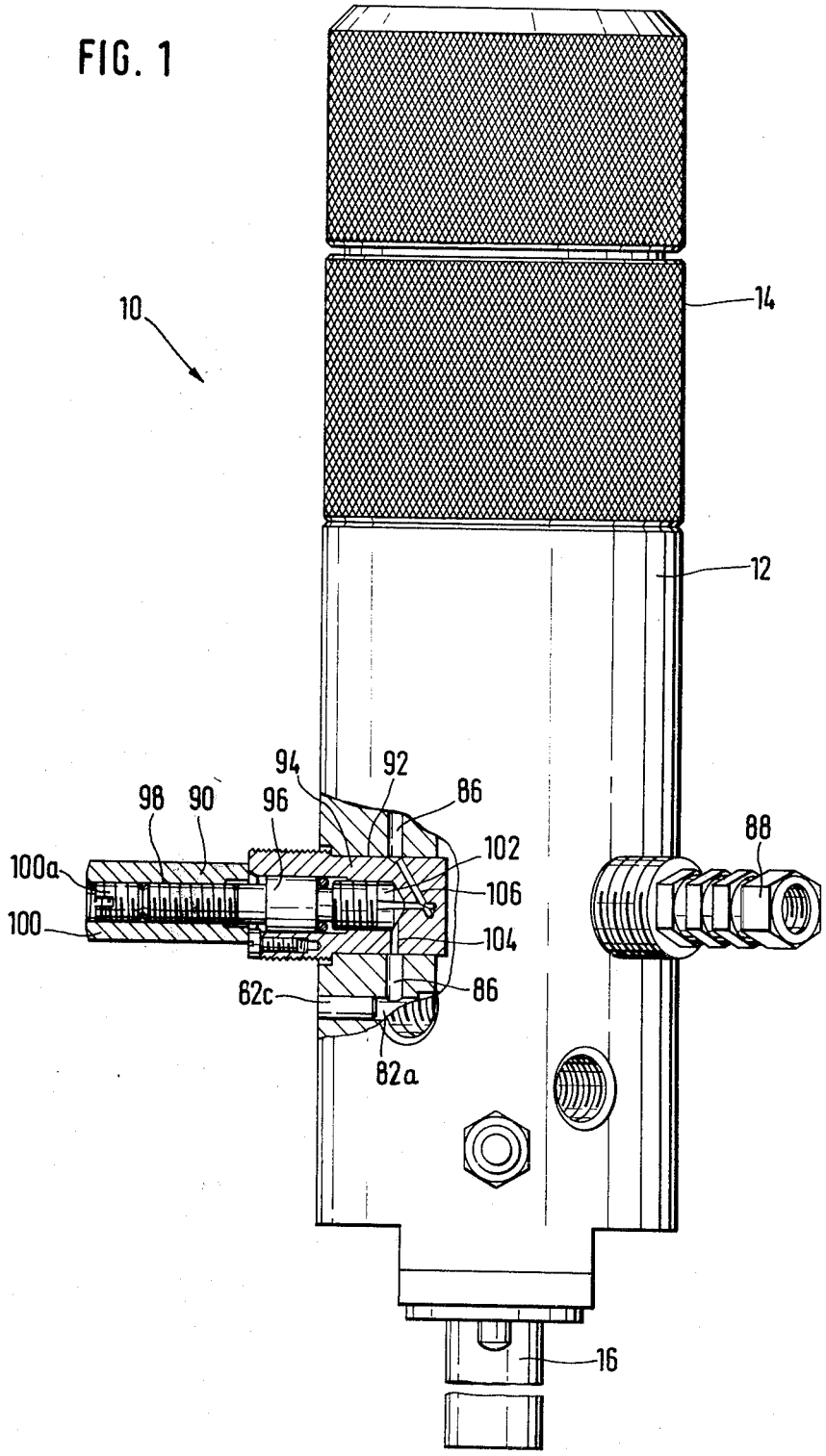
FIG. 1 is an elevation view partly in section of a device in accordance with this invention.
Figure 2:
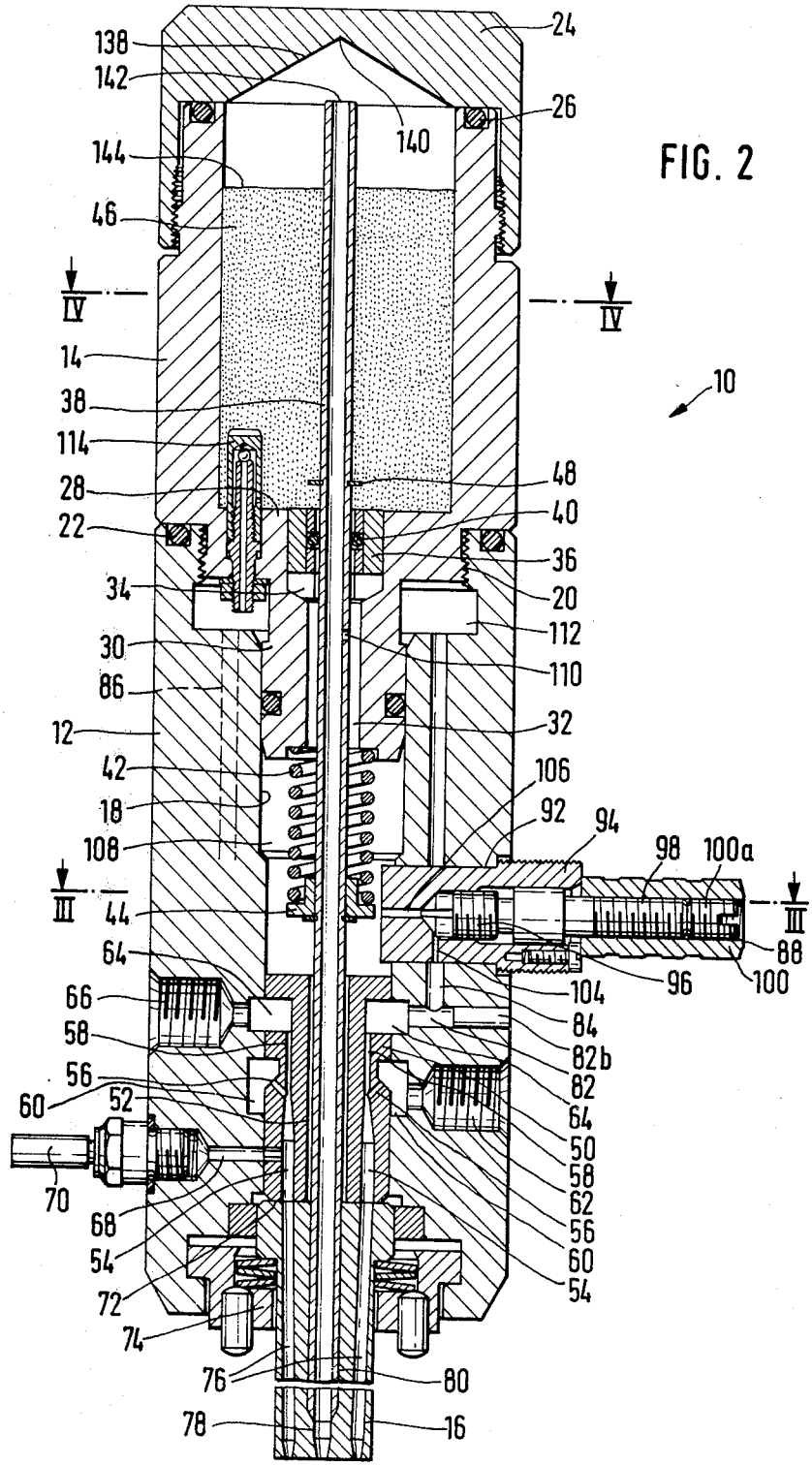
FIG. 2 is a cross-sectional view of the device of FIG. 1.
Figure 3:
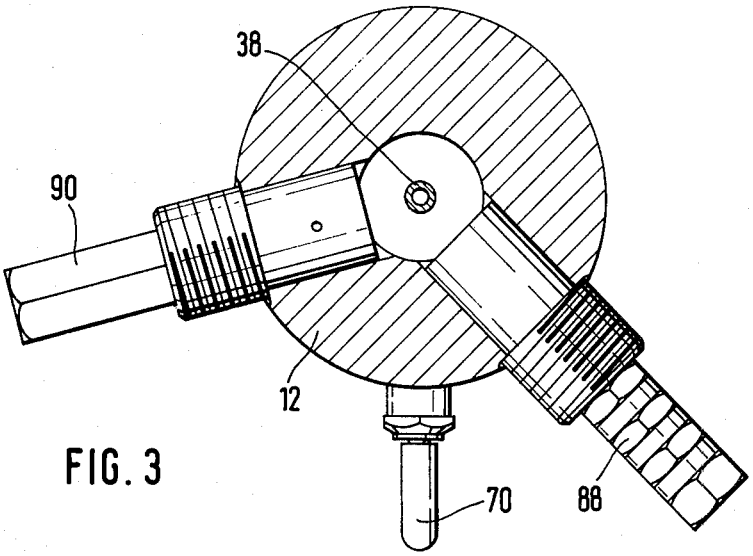
FIG. 3 is a cross-sectional view along the line III—III in FIG. 2.

FIGS. 1 and 2 show the general features of the inventive device 10 for marking workpieces by means of powder. As can be seen therein, the device 10 is essentially of threepart structure consisting of a burner 12 to whose upper end a powder container 14 is attached and to whose lower end a nozzle 16 is attached.

The burner 12 has a graduated central bore 18, whose upper end is equipped with an internal thread 20. This internal thread serves to hold the powder container 14, which sits gastightly on the burner 12 by means of a circumferential O-ring 22. The upper free end of the powder container 14 is closed gastightly by a screwed lid 24 under which is a further sealing joint 26.

As can be seen from FIG. 2, the powder container base 28 has a cylindrical projection 30 directed towards the nozzle 16; this projection is directed gastightly in a narrowed sector of the central bore 18 of the burner 12.

A bore 32 is in both the powder container base as well as in the projection 30 which goes into a larger diameter area 34 in the powder container base 28. In this area 34 a casing 36 is fixed gastightly, which serves as a receptor and conduit of a tube 38. There is a gastight connection between the threaded sleeve 36 and the relatively movable tube 38 by means of a circumferential O-ring 40.

At the lower end of the projection 30 is a depression, which serves to hold one end of the spring 42. The other end of this spring rests on a spring washer 44, which is attached to the tube 38.

The spring 42 covering the tube 38, has the capacity to push the tube downwards when the nozzle 16 is pressed. In order to prevent this from surpassing a given dimension, particularly to prevent the tube 38 from falling out of the device 10, there is a connector 48 in the interior chamber 46 of the powder container 14 near the threaded sleeve 36.

A mixer 50 which is tightly fitted into the central bore 18 of the burner 18 is in the lower section: this bore is graduated. A concentric bore 52 is also in the mixer 50 through which the tube 38 slides. In the concentric circle of the bore 52 several mixing conduits 54 are located, equidistant from one another into which a fuel gas conduit 56 as well as a heating oxygen conduit 58 open in the conical enlarged front sector. Every fuel gas conduit 56 is attached over an annulus 60 to a connector 62 for the fuel gas. A corresponding annulus 64 serves to attach the heating oxygen conduits 58 with a connector 66 for the heating oxygen.

As can further be seen in FIG. 2, one of the mixing conduits 54 is connected by way of a cut-off canal 68 to an ignition device 70 (e.g. spark plug, electric igniter).

On the frontal area of the mixer 50, FIG. 2 depicts the head 72 of the nozzle 16. The nozzle 16 is attached to the lower sector of the burner 12 by means of a number-checking arrangement 74 such that their mixture bores 76 align with the corresponding mixing conduits 54 in the mixer 50. The mixture bores 76 surround a concentric canal 78, whose upper sector 80, which is directed towards the mixer 50, assumes a larger diameter.

This enlarged sector 80 of the concentric canal 78 serves as a receptor and conduit of the tube 38, which locks gastightly into the nozzle 16 with its nozzle end when the nozzle 16 is fixed by the force of the spring 42. By means of this, a static-free passage from the interior space 46 of the powder container 14 into the concentric conduit 78 of the nozzle 16 is guaranteed.

The connector 66, which is attached to the annulus 64 supplies oxygen in two taphole bores 82, **82*a* (see FIGS. 1–2). From these taphole bores, two secondary pipes, in which controlling valves 88 and 90 are located, lead off. The taphole bores are gastightly sealed off from the atmosphere by means of plugs 82*b* and 82*c* (see FIGS. 1–2**).

The controlling valve 88 which is depicted in FIG. 2 is held by the clearance 92 through which the secondary pipe 84 penetrates. As can be seen, the controlling valve consists of a valve structure 94 in whose interior the valve 96 is axially adjustable. An adjusting casing 100 is screwed onto a threaded sector 98 of the valve 96 and is countered by a counterscrew **100*a*. The casing maintains such a longitudinal position against the valve 96 in its countered state that as it aligns with regard to the valve structure 94 the valve remains minimally open so that the valve cone 102 does not completely close the bore 106. The valve 96 can generally be moved in the valve structure 94** to and fro accordingly as the adjusting casing is turned to the right or to the left.

In the area of the valve cone 102 of the valve 96, these are two bores 104 and 106 in the valve structure 94 through which, when the controlling valve is open, the secondary pipe 84 achieves a connection with the chamber 108.

By means of a bore 110 in the wall of the tube 38, this chamber 108 is connected to the interior 46 of the powder container 14 for a reason that is to be explained later.

The controlling valve 90 in the secondary pipe 86 has the identical structure as the previously described controlling valve 88 as set forth in 94 to 96. However, contrary to what had been described in the controlling valve 88, when the valve 90 is in the closed position, the connection between the bores 104 and 106 is broken, whereas when the controlling valve 88 is in the closed position a small quantity of gas can flow from the secondary pipe 84 and over the first bore 104 to the second bore 106 and from there into the chamber 108. The bore 106 of the second controlling valve 90 is not connected to the chamber 108 but rather with the secondary pipe 86, which is closed only in the area of the valve 90 by its valve structure for the purpose of regulating the gas supply.

Since the controlling valve 90 is not depicted in the sectional representation in FIG. 2, the secondary pipe 86, for purposes of clarity, is shown in phantom. As can be seen, the secondary pipe 86 is connected to an annulus 112 which is structured at the underside of the powder container base 28, between the internal wall of the burner 12 and the outer perimeter of the projection 30.

Figure 4:
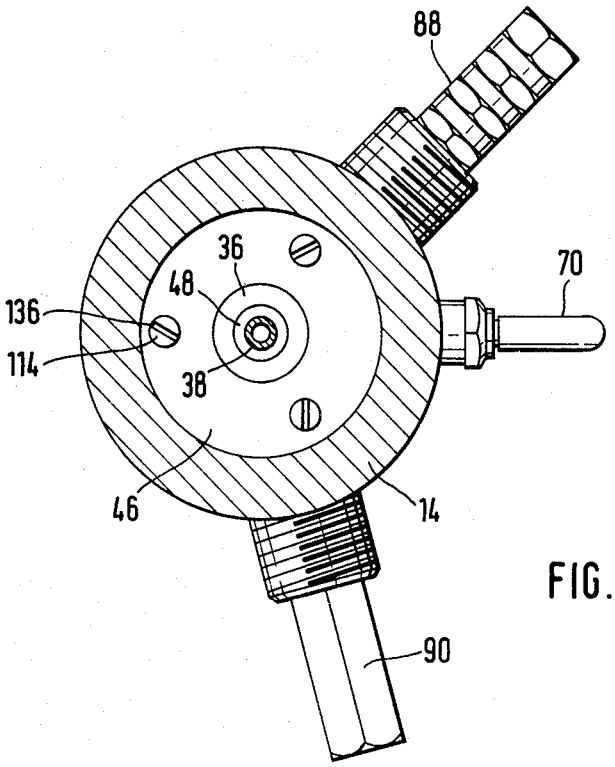
FIG. 4 is a cross-sectional view along the line IV—IV in FIG. 2.

In exemplification of the operation, there are three swirl-type nozzles, whose one end projects into the annulus 112 and whose other end can be found in the interior chamber 46. As is depicted in FIG. 4, the three swirl-type nozzles 114 are set upon a common divided circle at 120°.

Figure 5:
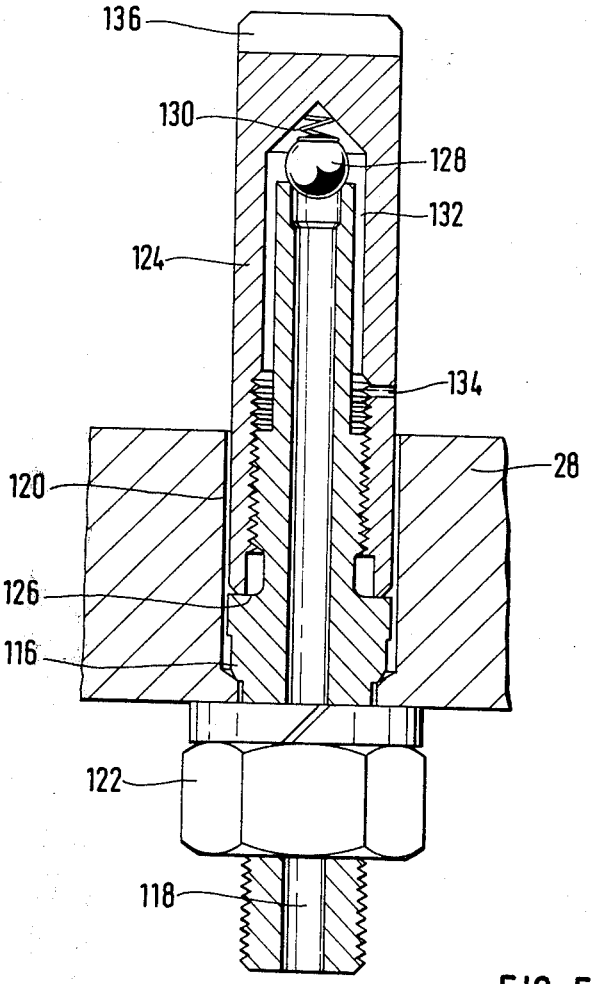
FIG. 5 is an enlarged sectional representation of a swirl-type nozzle.

FIG. 5 shows in an enlarged fashion a representation of the structure of such a swirl-type nozzle. The swirl-type nozzle has a main body 116 to which a concentric middle bore 118 is attached. As can be seen, the swirl-type nozzle is held by a bore 120 in the powder container base 28 and is thus supported in this device. A screw connector 122 located in the annulus serves to stabilize the swirl-type nozzle. The bore 120 is so measured that onto its main body 116 an extra sealing cap 126 can be screwed: this extra sealing cap is installed on a section 126 of the main body 116.

In FIG. 5, there is a sealing bearing 128 at the upper end of the main body 116, which in its resting state, closes the upper end of the middle bore 118 by means of a spring 130. This middle bore is connected to the interior 46 of the powder container 14 by way of the elevated sealing bearing 128 over the ring slot 132 and a bore 134, which is located in the sealing cap 124.

There is a slit 136 at the upper end of the sealing cap 124 (see FIG. 4), by which the swirl-type nozzle can be adjusted during the assemblage of the device using a screw driver.

Finally, as can be seen in FIG. 2, the lid 24, which gastightly closes the powder container 14 is equipped with a conical recess 138, whose apex 140 lies exactly opposite the bore 142 of the tube.

The device for marking workpieces by means of powder as described according to the specifications of the invention and appropriately illustrated, works as follows:

First of all, a marking powder, for example zinc powder 144, is fed into the powder container 14. After gastightly closing the powder container with the lid 24, heating oxygen is passed by way of valves (which have not been presented in the illustration) and the fuel gas over the conduits 62 and 66 into the burner 12. By way of the annuli 63 and 60, heating oxygen and fuel gas reach the mixer 50 in the interior of the burner and undergo a mixing process in its canal 54 into an ignitable mixture. By way of the ignition device 70 which is connected to a mixing canal 54 by means of its cut-off canal 68, ignition of the heating oxygen-fuel gas mixture occurs so that a circular ring-shaped heating flame sheath is formed.

As set forth herein a part of the heating oxygen gets over the annulus 64 into the cut-off bores 82 and 82*a*, which—as has already been mentioned—are connected with the secondary pipes 84 and 86. By way of the first secondary pipe 84, heating oxygen flows into the chamber 108 of the concentric bore 18 according as the controlling valve 88 is in the open position. From this area, the oxygen reaches the wall of the tube 38 via the bore 110 and flows in this tube in the direction of the interior chamber 46 of the powder container 14 as well as towards the concentric canal 78 of the nozzle 16. The controlling valve 88 is so conceived that even when it is in the closed position, the oxygen can still flow into the chamber 108 and hence into the interior of the tube 38. This has the advantage that even when the controlling valve is closed, oxygen leaves the concentric canal 78 and therefore prevents backward flow of part of the heating oxygen-fuel gas mixture, which emanates from the mixing bores 76 of the nozzle 16 into the concentric canal 78. The constant, albeit, weak oxygen flow from the canal 78 consequently acts as a sort of backflow barrier for the fuel-gas mixture.

By way of the other secondary pipe 86 which is intercepted by the controlling valve 90, oxygen reaches the annulus 112 under the powder container base 28 according as the valve is in the open position. Since this annulus is connected to the swirl-type nozzle 114, the oxygen reaches the anterior 46 of the powder container 14 through its middle bore 118 over the ring slot 132 and through the opening 134 in the sealing cap 124.

The swirl-type nozzles 114 are set up in the same fashion, that is, their bores 134 are pointed in the same direction, so that by blowing out the oxygen, a rotation action is exerted on the zinc powder 144 in a clockwise (or counterclockwise) manner.

Since, in an advantageous sense, the openings 134 of the swirl-type nozzles are only barely above the powder container base 28 (a distance of about 1–3 mm), it is hereby guaranteed that the entire powder filling will be aerated and thereby go into ebullition. Also since oxygen flows into the interior chamber 46 of the powder container 14 from the opening 142 of the tube 38 and, in fact, by way of the first controlling valve 88, it is necessary to set the second controlling valve 90 in such a way that the pressure of the oxygen as it leaves the swirl-type nozzles 114 be greater than that part of the oxygen flowing back from the tube 38. If during the initial phase of the pressure this is not the case, or, if the second controlling valve 90 is closed, a certain quantity of oxygen still flows into the powder container 14 by way of the first controlling valve 88 even when this is in the closed position; there is therefore the danger that powder can be forced back into the swirl-type nozzles 114 and, undesirably, by way of the annulus 112 into the oxygen conduits. To prevent this from occuring, the middle bore 118 is closed by the sealing bearing 128 (see FIG. 5), which is held in position by the spring 130 as depicted in FIG. 5. This bearing acts, therefore, as a type of back flow barrier when the controlling valve 90 is closed, so that penetration of very finely divided zinc powder into the oxygen conduits is prevented.

If now, as desired, the prssure of the oxygen emanating from the swirl-type nozzle 114 is greater than the pressure of the oxygen back flow (tube 38), then a foggy zinc powder-oxygen mixture is formed by means of this turbulent oxygen in the free chamber of the powder container 14 above the level of the zinc powder 144, which flows into the tube 38 because of its greater pressure. When this foggy zinc powder-oxygen mixture reaches the opening 110 of the tube 38 where actually division of the in-flowing oxygen occurs (coming from the controlling valve 88), the flow velocity of the mixture is additionally accelerated by means of the oxygen component, which flows in the direction of the concentric canal 78 of the nozzle 16. Depending upon the open position of the first controlling valve 88, the exit velocity of the zinc powder-oxygen mixture from the nozzle 16 can be varied.

Variation of the exit velocity of the zinc-powder-oxygen mixture from the nozzle 16 implies also, alteration of the length of the oxygen-powder mixture spray and, as already explained, the required longitudinal accommodation of the mixed spray in the stipulated changing distance of the nozzle 16 to the workpiece surface. Depending upon how the second controlling valve 90 is open, more or less of the zinc powder will be blown out of the nozzle 16. If the distance of the nozzle from the target workpiece is unchanged, there will be a corresponding change in the width of the marking line, that is, the wider the valve 90 is open, the greater the width of the marking line assuming that other parameters remain unchanged.

If it is not only ferrous metallic workpieces which have to be marked, but also non-ferrous metals, mostly copper and copper alloys for which generally more heat is required, it is necessary to bring the nozzle 16 nearer to the surface of the workpiece and simultaneously to reduce the marking speed, so that the heat generated by the heating flame can be increased. In such a case, it is necessary to close the controlling valve 88 in such a way that the additional acceleration of the exit velocity of the zinc-powder-oxygen mixture lessens and thereby the length of the mixed spray is shortened so that an accommodation to the now altered distance of the nozzle to workpiece occurs. In this situation, valve 90 by greater or lesser opening also controls the quantity of zinc-powder-oxygen mixture and hence also the width of the marking line. The zinc-powder, which emanages from the nozzle 16 reaches, in fine spray, the surface of the workpiece which has been strongly heated by the heating flame, where it liquefies and bonds to the material in the form of a narrow ineffaceable line.

According as the controlling valve 90 is set, the width of the marking line on the workpiece fluctuates between 0.4 to 1.2 mm, whereby, in such a case, the oxygen supply pressure is about 1 atmosphere and the diameter of the concentric canal 78 from which the zinc powder flows, is about 0.6 mm. If, at the same oxygen supply pressure a canal diameter greater than 0.6 mm is selected, the width of the ensuing marking line is accordingly increased.

Through this inventive device for marking workpieces by means of powder, it is guaranteed that if the powder container is filled over a long period of time, an optimal marking line can be reached, whose width is adjustably by the controlling valve 90, and when changing the distance of the nozzle to the workpiece surface, it is additionally adjustable by the controlling valve 88. Because of the way in which the device is constructed, it is further guaranteed that the marking powder can only be propelled forwards when the heating oxygen required for forming the fuel gas-mixture in production of the heating flame is flowing.

An unnecessary and undesirable flow of powder is hereby effectively prevented. Beyond this, it is also ensured that as long as no powder is flowing as for example when the powder container is empty, no fuel gases can backflow into the tube 38, since the oxygen current from the controlling valve 88 via bore 110, which aids the powder flow into the tube 38 acts as a backflow barrier.

As previously described, the so-called powder marker finds application in the marking of workpieces. For this purpose, the powder is conducted into the heating flames of a burner where it liquefies and eventually reaches the workpiece which is to be marked. Usually, a burner, which can be used alternately as a cutting and as a marking burner, is used. As can be appreciated from the foregoing description, the invention provides a device, which, along, serves to mark with powder. For this purpose a burner is employed, one end of which is equipped with a marking nozzle and to whose other end is attached the associated powder container. In this manner, a compact unit, which can easily be mounted onto a flame cutting machine, is obtained.

What is claimed is:

1. In a device for marking workpieces by means of powder with a nozzle from which, concentrically, a powder spray circumscribed by a heating flame emanates, the improvement being a burner, one end of said burner being attached to said nozzle for powder marking, the other end of said burner being attached to a powder container which is connected to said nozzle by means of a tube, said tube being equipped with a spring, one end of said spring being attached to a spring washer, and the other end of said spring resting against a projection of the base of said powder container.

2. Device as set forth in claim 1 characterized by the fact that said tube is incorporated into the central canal of said nozzle by an enlarged end sector.

3. Device as set forth in claim 1 characterized by the fact that said nozzle is connected to a mixer for making a fuel gas-oxygen mixture used in the heating flame in such a manner that the gases can be supplied to said mixer through separate canals over said burner.

4. Device as set forth in claim 1 characterized by an oxygen pipe, secondary pipes branch off from said oxygen pipe, and said secondary pipes having built-in controlling valves.

5. In a device for marking workpieces by means of powder with a nozzle from which, concentrically, a powder spray circumscribed by a heating flame emanates, the improvement being a burner, one end of said burner being attached to said nozzle for powder marking, the other end of said burner being attached to a powder container which is connected to said nozzle by means of a tube, an oxygen pipe, secondary pipes branching off from said oxygen pipe, said secondary pipes having built-in controlling valves, a first of said secondary pipes being connected to an intermediary mixer, and said powder container having a projection extending into the area of said burner.

6. Device as set forth in claim 5 characterized by the fact that a bore is in the wall of said tube through which said burner area is connected with both the interior space of said powder container and the concentric canal of said nozzle.

7. Device as set forth in claim 6 characterized by the fact that the other of said secondary pipes is in connection with an annulus located at the underside of said powder container.

8. Device as set forth in claim 7 characterized by the fact that swirl-type nozzles are at the base of said powder container, and each swirl-type nozzle having a middle bore leading to said annulus.

9. Device as set forth in claim 8 characterized by the fact that each of said swirl-type nozzles has a main body to which a locking cap is screwed, a ring slot being between said locking cap and said main body, and said ring slot being connected via an opening in said locking cap to both the interior space of said powder container and said middle bore.

10. Device as set forth in claim 9 including a spring-loaded sealing ball bearing at the upper end of said middle bore of said main body.

11. Device as set forth in claim 10 characterized by the fact that an evaporation-proof lid is screwed onto said powder container and has in its interior base a conical clearance whose peak is connected to an opening in said tube.

12. Device as set forth in claim 11 characterized by the fact that the cap opening is located in the immediate area of said powder container base.

* * * * *